US006254679B1

(12) United States Patent
Sancenot

(10) Patent No.: US 6,254,679 B1
(45) Date of Patent: Jul. 3, 2001

(54) DEVICE FOR UNIFORMLY MOISTENING LABELS

(75) Inventor: Gilbert Sancenot, Paris (FR)

(73) Assignee: Neopost Industrie, Bagneux (FR)

( * ) Notice: Subject to any disclaimer, the term of this patent is extended or adjusted under 35 U.S.C. 154(b) by 0 days.

(21) Appl. No.: 09/181,640

(22) Filed: Oct. 29, 1998

(30) Foreign Application Priority Data

Nov. 3, 1997 (FR) ..... 97 13798

(51) Int. Cl.[7] ..... B05C 3/00
(52) U.S. Cl. ..... 118/401; 118/216
(58) Field of Search ..... 118/401, 216, 118/225; 156/390, 578

(56) References Cited

U.S. PATENT DOCUMENTS 2,686,607 8/1954 Zander .
5,455,062 * 10/1995 Muhlfriedal et al. .
5,622,560 * 4/1997 Haroutel et al. .

FOREIGN PATENT DOCUMENTS 0 550 326 A1 7/1993 (EP) .

* cited by examiner

*Primary Examiner*—Brenda Adele Lamb
(74) *Attorney, Agent, or Firm*—Sughrue, Mion, Zinn, Macpeak & Seas, PLLC

(57) ABSTRACT

The invention relates to a device for moistening labels, each of which has a face that is pre-gummed, which device enables the gummed face of each of the labels to be moistened uniformly. The device comprises a moistening element constituted by a rigid bar whose top portion comes into contact with the gummed face of each of the labels and is provided with capillary action slots passing through said bar in the advance direction of the labels, slanting relative to said advance direction, and having respective bottoms immersed in a moistening liquid that is maintained at a constant level.

5 Claims, 2 Drawing Sheets

DEVICE FOR UNIFORMLY MOISTENING LABELS

TECHNICAL FIELD

The invention relates to a device for uniformly moistening a flexible strip such as a strip of paper or of any other commercially-available pre-gummed flexible medium used for sticking the postage on or "franking" letters, packets and parcels, for packaging, and for labelling.

PRIOR ART

The simplest and therefore the most common type of device for moistening a pre-gummed flexible strip comprises a moistening element constituted by a sponge or by a felt. It is known that that type of moistening element does not wear well over time.

European Patent Application No. 0 293 316 describes a device for moistening pre-gummed labels. That device comprises a moistening element in the form of a brush made up of a sheet of bristles. The brush is placed in a tank filled with a moistening liquid suitable for diluting the glue. The bottom portion of the brush remains immersed in the moistening liquid which is maintained at a constant level. The top portion of the brush is moistened with liquid by capillary action, and it is maintained in contact with the gummed faces of the labels while they advance past the brush. Although the brush wears better over time than does a sponge or a felt, it suffers from the drawback of not distributing the moistening liquid over the gummed faces of the labels uniformly, over time, because it gathers glue. The ends of the bristles of the brush scraping over the gummed faces of the labels causes glue to be deposited between the bristles of the brush. As a result, the brush clogs up because glue remains trapped between the bristles of the brush, without it being possible for the trapped glue to be removed while the labels are advancing. That gives rise to poor transfer of moistening liquid to the labels, with certain portions of the gummed faces of the labels being scrubbed, and, as a result, moistening of the labels is not uniform over time.

French Patent FR 91 16369 filed in the Applicants' name discloses a rigid moistening element provided with parallel capillary action slots which enable glue residue to be removed continuously by channeling the moistening liquid through the capillary action slots. Unfortunately, although that element is entirely satisfactory for numerous uses, it has become apparent that, when labels are not provided with enough glue, and therefore require extra moistening liquid, the moistening becomes less effective, thereby giving rise to poor sticking of the labels or of an envelope opening when the flexible strip to be stuck is constituted by an envelope flap.

DEFINITION AND OBJECT OF THE INVENTION

An object of the present invention is to provide a device for moistening a flexible strip, which device comprises a moistening element and does not suffer from the above-mentioned drawbacks, and in particular maintains moistening that is uniform even with a surplus of moistening liquid.

To this end, the invention provides a device for moistening a flexible strip having a face that is gummed at least in part, the device comprising a moistening element in the form of a rigid bar having a bottom portion immersed in a moistening liquid and a top portion moistened with said liquid by capillary action and in contact with the gummed face while said strip is advancing in an advance direction against said moistening element, said top portion of the moistening element being provided with a plurality of capillary action slots passing through said bar in said advance direction, which slots have respective bottoms immersed in the moistening liquid, wherein said capillary action slots slant relative to the advance direction in a manner such as to enable the entire width of the gummed face of the flexible strip to be moistened.

By slanting the moistening slots, the degree of moistening is increased because the entire gummed surface of the strip is swept, and it is thus moistened uniformly. In a prior art device, since the edges of the bar are not moistened, they can cause a label to be damaged or to come unstuck even if the label has already been stuck. In addition, compared with prior art devices, the priming time is reduced to a few seconds because of the larger volume of liquid that is displaced.

Advantageously, an end portion of a capillary action slot located in alignment in said advance direction with an end portion of an adjacent capillary action slot.

BRIEF DESCRIPTION OF THE DRAWINGS

Other characteristics and advantages of the present invention appear more clearly on reading the following detailed description of an embodiment of the invention given with reference to the accompanying drawings, in which.

DETAILED DESCRIPTION OF A PREFERRED EMBODIMENT

Figure 1:
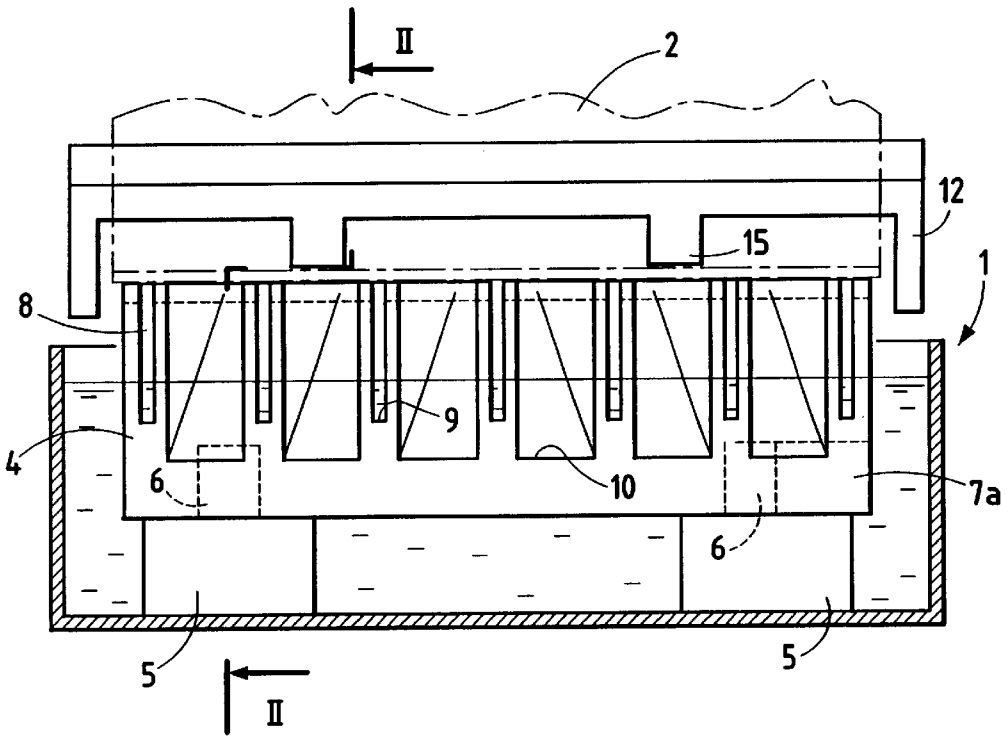
FIG. 1 is a diagrammatic front view of the device of the invention, with the tank being shown in section.

In the figures, like reference numerals designate like elements.

As shown in FIG. 1, the device 1 for moistening a flexible strip such as a strip of paper 2 having a face that is gummed at least in part, such as a label, comprises a tank 3 in which a rigid bar 4 is placed. The bar is substantially rectangular block shaped with its top portion projecting relative to the opening of the tank. The rigid bar 4 rests on mountings 5 secured to the bottom of the tank, and it is held against said mountings by means of studs 6 fixed to the mountings 5 and being forced into recesses 7 provided in the bottom portion of the bar. Keying means 7*a* may optionally be provided to enable the bar to be mounted correctly. In this configuration, the rigid bar is removably mounted so that it can be removed from the tank whenever necessary. It can thus be replaced with a standard bar (as described in Patent FR 91 16369 which is mentioned in the preamble) when it is not essential to use of an improved bar of the invention.

Figure 2:
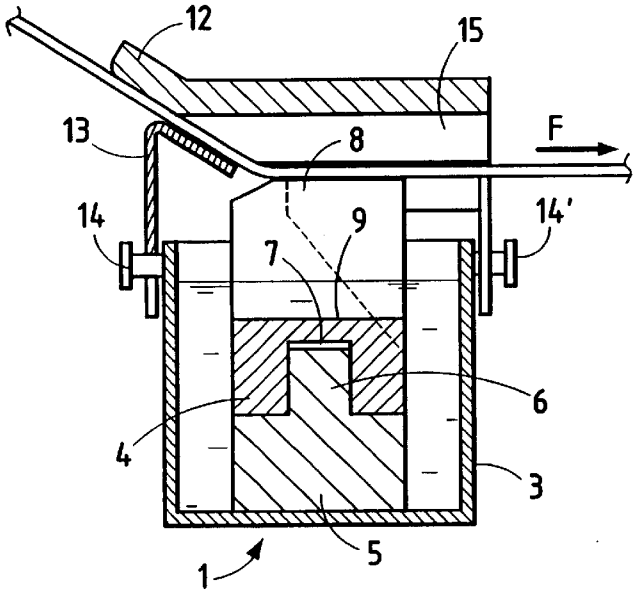
FIG. 2 is a diagrammatic section view on plane II—II of FIG. 1.

The strip of paper 2 is propelled conventionally by means of a set of rollers and backing rollers (not shown), and it advances above the bar in an advance direction as represented by arrow F, the advance direction of the strip of paper being perpendicular to the longitudinal axis of the bar as installed in the tank and as shown in FIG. 2. The pre-gummed face of the strip of paper faces the top portion of the rigid bar and comes flush therewith.

Figure 3:
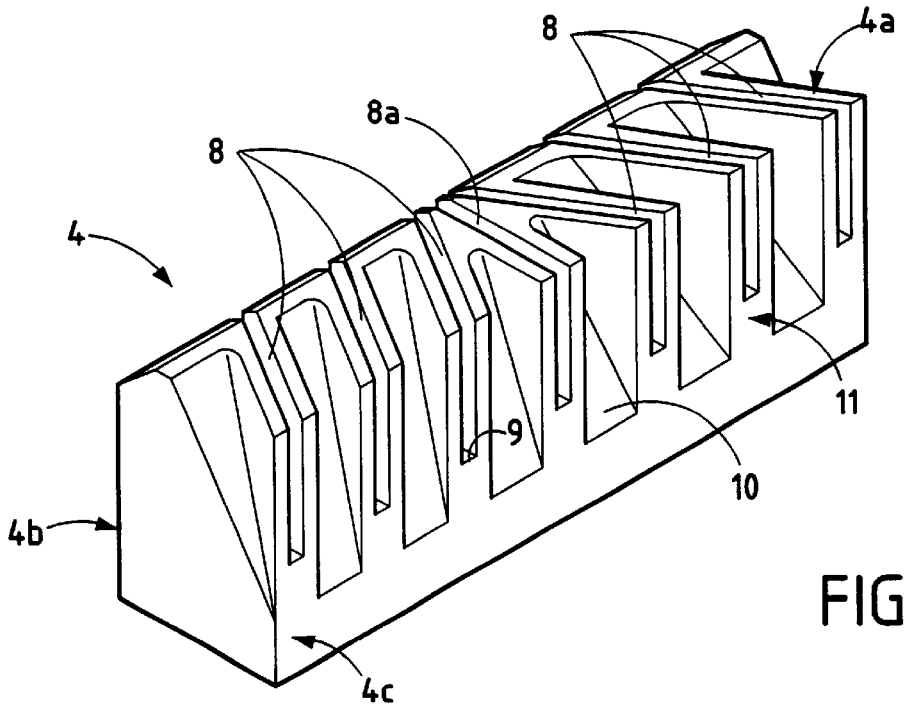
FIG. 3 is an isometric perspective view of the improved bar of the invention.
Figure 4:
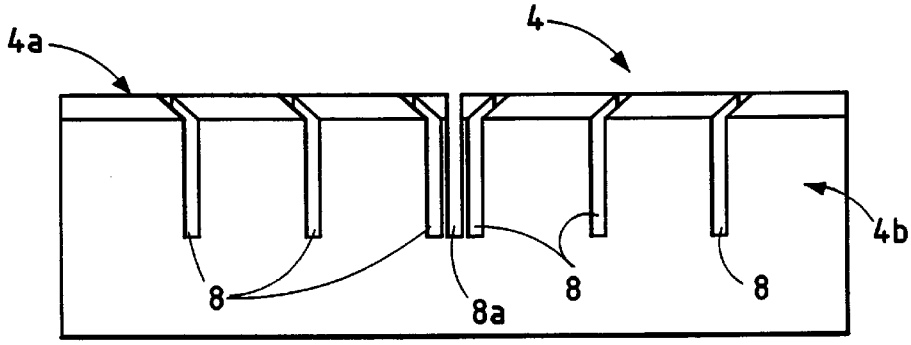
FIGS. 4 and 5 are respectively a front view and a plan view of the bar shown in FIG. 3.

The top portion of the bar is provided with a plurality of capillary action slots 8 passing through said bar in the advance direction of the strip of paper and shown in isometric perspective in FIG. 3. Each capillary action slot 8 opens out on the top face 4*a*, on the front face 4*b*, and on the back face 4*c* of the rigid bar 4. It may be noted that the front face 4*b* is slightly bevelled along its top front edge where it meets the top face 4*a*, so as to facilitate insertion of the flexible strip. Naturally, to obtain the same effect, the slots could be designed to open out only on the top face 4*a* and on the back face 4*c* of the bar.

Figure 5:
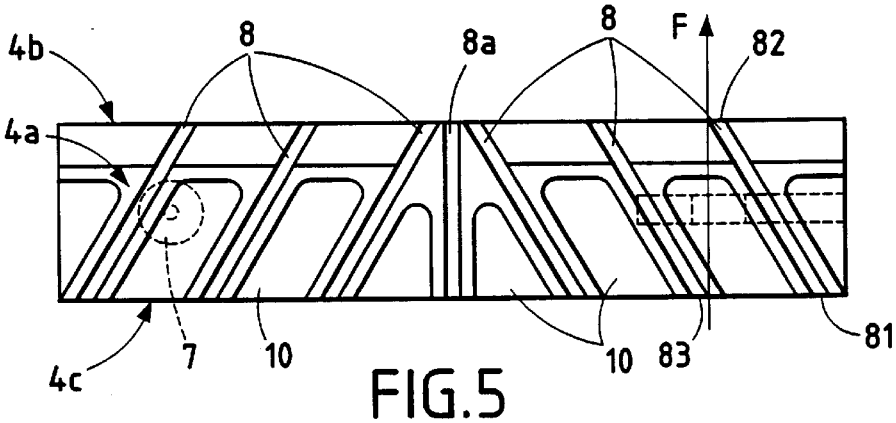

According to the invention, the slots slant relative to the advance direction so that the entire width of the gummed face of the flexible strip is moistened. Thus, as can be seen in FIG. 5 which is a plan view of the improved bar, an end portion (e.g. the portion 82 at the front face 4*b*) of a capillary action slot is located substantially in alignment in the advance direction F with an end portion (e.g. the portion 83 at the back face) of an adjacent capillary action slot. By means of this configuration, even the longitudinal edges (relative to the advance direction) are maintained correctly moistened, and in particular the right longitudinal edge is moistened by an end portion referenced 81, for example. In a preferred embodiment of the invention, the capillary action slots slant symmetrically relative to the advance direction (forming a kind of chevron configuration), and the bar 4 is advantageously further provided with a central slot 8*a* parallel to said advance direction. The slant is optimized as a function of the moistening capacity of the bar, as a function of the total width of the strip, and as a function of the number of capillary action slots. Thus, for example, for moistening labels available continuously from a roll, the Applicant has observed that a bar provided with seven slots, six of which slant at 30°, makes it possible to obtain very satisfactory results with a rate of insufficiently-moistened labels being reduced by almost 100% compared with the results obtained with a standard bar as defined in Patent FR 91 16369.

The tank 3 is filled with a moistening liquid such as a glue-diluting liquid, e.g. water, whose level is maintained constant by any suitable means, such as those described in above-mentioned Patent Application EP 0 293 316, so that the bottoms 9 of the slots are continuously immersed in the moistening liquid.

The bar 4 may be made of an injected thermoplastics material suitable for bringing the moistening liquid from the bottoms 9 of the capillary action slots to the top face 4*a* of the bar by capillary action. The bar is placed transversely relative to the advance path of the strip of paper 2 so that the top portion of said bar, as moistened with said liquid by the capillary action, sweeps the entire gummed face of the strip of paper.

The top portion of the bar 4 is also provided with notches 10 disposed between the capillary action slots 8 and parallel therewith in places. As shown in FIGS. 1 and 3, the notches are wider than the capillary action slots, thereby facilitating returning any surplus water to the tank 3, while keeping the friction area over which the flexible strip rubs against the bar as small as possible (this removal of material also serves to reduce the weight of the bar). As can be understood, in the bar, each tooth 11 formed between two notches 10 (the total extent of each tooth in the label travel direction being greater than the extent of a notch) is provided with a capillary action slot 8 whose width is very small (of the order of a few tenths of a millimeter). The number of teeth and then number of notches are chosen as a function of the width of the strip of paper, and as a function of the quality of the paper. In the example shown in the figures, the bar 4 is provided with seven capillary action slots for moistening a strip of paper whose width is about 4 cm. The speed of advance of the strip of paper, the height of the level of glue-diluting liquid relative to the bottoms of the capillary action slots, the width of said slots, and their slant relative to the advance direction make it possible to vary the quantity of water deposited on the gummed face of the strip of paper.

With reference to FIGS. 1 and 2, it can be observed that guide means for guiding the strip of paper and constituted by a top portion 12 and by a bottom portion 13 are fixed to the tank 3 by respective fixing screws 14, 14', these two portions being disposed on either side of the strip of paper 2. The top portion 12 of the guide means, which portion is mounted above the strip of paper so as to press the strip of paper 2 against the top portion of the bar 4*a*, is provided with a plurality of ribs 15 facing the top portion of the bar 4*a*. Each rib 15 extends parallel to the advance direction, preferably facing a notch 10. The top portion 12 of the guide means may also be hinge mounted to pivot between a first position in which it is positioned above the strip of paper 2 so as to press it against the top portion of the bar 4*a* and a second position in which it forms a deflector preventing the strip of paper 2 from coming flush with the top portion of the bar 4*a*.

Naturally, the invention is not limited to the above-described embodiment, and other variants are possible without going beyond the ambit of the invention. In particular, it is possible to consider disposing the capillary action slots so that they are merely mutually parallel and slanting relative to the advance direction by a determined angle, naturally provided that such a configuration enables the strip to be swept entirely.

What is claimed is:

1. A device for moistening a flexible strip having a face that is gummed at least in part, the device comprising a moistening element in the form of a rigid bar having a bottom portion immersed in a moistening liquid and a top portion moistened with said liquid by capillary action and in contact with the gummed face while the flexible strip is advancing in an advance direction against said moistening element, said top portion of the moistening element being provided with a central slot and a plurality of capillary action slots passing through said bar in said advance direction, which said capillary action slots have respective bottoms immersed in the moistening liquid, wherein said central slot extends parallel to the advance direction and said capillary action slots are inclined relative to said central slot and the advance direction in a manner such as to enable the entire width of the gummed face of the flexible strip to be moistened.

2. A device according to claim 1, in which an end portion of one of said capillary action slots is located in alignment in the advance direction with an end portion of an adjacent one of said capillary action slots.

3. A device according to claim 1, in which said capillary action slots are inclined symmetrically relative to the advance direction.

4. A device according to claim 1, in which the incline of said capillary action slots is determined as a function of the moistening capacity of the bar, as a function of the width of the flexible strip, and as a function of the number of capillary action slots.

5. A device according to claim 1, in which the top portion of the bar is provided with notches disposed between said capillary action slots and is wider than said capillary action slots.

* * * * *